US008596739B2

(12) United States Patent
Lee et al.

(10) Patent No.: US 8,596,739 B2
(45) Date of Patent: Dec. 3, 2013

(54) PRINTING METHOD AND PRINTER

(75) Inventors: Dong-Won Lee, Yongin (KR); Tae-Yong Noh, Yongin (KR); Sang-Hun Park, Yongin (KR); Young-Mok Son, Yongin (KR); Hyea-Weon Shin, Yongin (KR); Young-Il Kim, Yongin (KR); Seong-Ho Kim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 302 days.

(21) Appl. No.: 13/028,800

(22) Filed: Feb. 16, 2011

(65) Prior Publication Data

US 2011/0199409 A1 Aug. 18, 2011

(30) Foreign Application Priority Data

Feb. 16, 2010 (KR) ..... 10-2010-0013843

(51) Int. Cl.
*B41J 29/38* (2006.01)

(52) U.S. Cl.
USPC ..... 347/9

(58) Field of Classification Search
CPC ..... B41J 25/003
USPC ..... 347/107, 108, 109, 20, 32, 38, 40, 9
See application file for complete search history.

(56) References Cited

U.S. PATENT DOCUMENTS 6,406,126 B1 * 6/2002 Clark ..... 347/37
7,252,353 B2 8/2007 Silverbrook et al.
7,374,266 B2 5/2008 Walmsley et al.
7,377,609 B2 5/2008 Walmsley et al.
7,427,117 B2 9/2008 Jackson Pulver et al.
7,448,707 B2 11/2008 Jackson Pulver et al.
7,484,831 B2 2/2009 Walmsley et al.
7,549,715 B2 6/2009 Walmsley et al.
7,735,944 B2 6/2010 Silverbrook et al.

(Continued)

FOREIGN PATENT DOCUMENTS

JP 2002-273868 A 9/2002
JP 2003-089195 A 3/2003

(Continued)

OTHER PUBLICATIONS

Korean Registration Determination Certificate issued on Jun. 25, 2012 in the corresponding Korean Patent Application No. 10-2010-0013843.

*Primary Examiner* — Manish S Shah
*Assistant Examiner* — Yaovi Ameh
(74) *Attorney, Agent, or Firm* — Robert E. Bushnell, Esq.

(57) ABSTRACT

A printing method and a printer for implementing the printing method are disclosed. When a printhead including a first end and a second end sequentially prints a first area and a second area which are adjacent to each other, the method comprises performing printing by means of the printer by relatively moving locations of the printhead and a print object in such a way that a surface printed by the second end in the first area and a surface printed by the second end in the second area face each other. The printhead rotates around a rotational axis comprising at least one point on the printhead, one end of the printhead, a center of the printhead, or both ends of the printhead.

24 Claims, 15 Drawing Sheets

(56) References Cited

U.S. PATENT DOCUMENTS

| | | | | |
|---|---|---|---|---|
| 2002/0105688 | A1 | 8/2002 | Katagami et al. | |
| 2003/0058290 | A1 | 3/2003 | Tanuma | |
| 2005/0110852 | A1* | 5/2005 | Lee et al. | 347/97 |
| 2006/0087525 | A1 | 4/2006 | Jackson Pulver et al. | |
| 2006/0092222 | A1 | 5/2006 | Jackson Pulver et al. | |
| 2006/0125858 | A1 | 6/2006 | Silverbrook et al. | |
| 2006/0132516 | A1 | 6/2006 | Walmsley et al. | |
| 2006/0132521 | A1 | 6/2006 | Walmsley et al. | |
| 2006/0139380 | A1 | 6/2006 | Walmsley et al. | |
| 2006/0139386 | A1 | 6/2006 | Silverbrook et al. | |
| 2006/0164453 | A1 | 7/2006 | Silverbrook et al. | |
| 2006/0164454 | A1 | 7/2006 | Walmsley et al. | |
| 2006/0209107 | A1 | 9/2006 | Kwon et al. | |
| 2006/0238565 | A1 | 10/2006 | Jung et al. | |
| 2006/0290764 | A1* | 12/2006 | Nagae et al. | 347/107 |
| 2007/0195118 | A1 | 8/2007 | Iwata | |
| 2007/0291070 | A9 | 12/2007 | Silverbrook et al. | |
| 2008/0024556 | A9 | 1/2008 | Silverbrook et al. | |
| 2008/0204519 | A1 | 8/2008 | Silverbrook et al. | |
| 2008/0284804 | A1* | 11/2008 | Seccombe | 347/9 |
| 2009/0033702 | A1* | 2/2009 | Clark | 347/14 |
| 2009/0091603 | A1 | 4/2009 | Silverbrook et al. | |
| 2009/0195579 | A1 | 8/2009 | Tousi et al. | |
| 2009/0213165 | A1* | 8/2009 | Burke et al. | 347/19 |

FOREIGN PATENT DOCUMENTS

| | | |
|---|---|---|
| JP | 2005-119180 | 5/2005 |
| JP | 2006-159114 A | 6/2006 |
| KR | 10-2006-0034869 | 4/2006 |
| KR | 10-2006-0098305 | 9/2006 |
| KR | 10-2007-0085166 A | 8/2007 |

* cited by examiner

PRINTING METHOD AND PRINTER

CLAIM OF PRIORITY

This application makes reference to, incorporates the same herein, and claims all benefits accruing under 35 U.S.C. §119 from an application earlier filed in the Korean Intellectual Property Office on the 16 Feb. 2010 and there duly assigned Serial No. 10-2010-0013843.

BACKGROUND OF THE INVENTION

1. Field of the Invention

The present invention relates to a printer and a printing method, and more particularly, to a printer and a printing method for reducing a deviation between nozzles.

2. Description of the Related Art

Generally, a display device converts data processed by a data processing device into an image. Examples of the display device include a liquid crystal display (LCD) device, an organic electroluminescent (EL) display device, and a plasma display panel (PDP). Such display devices are flat display devices which have smaller volume and weight than cathode-ray tube display devices.

The flat display devices commonly have a pixel pattern for displaying an image. For example, the LCD device includes various pixel patterns, such as a thin film transistor (TFT), a gate signal line, a data signal line, a pixel electrode, a black matrix, a color filter, and a common electrode. For example, the organic EL display device includes various pixel patterns, such as an anode electrode, an electron injection layer (EIL), a hole injection layer (HIL), a cathode electrode, and an organic layer.

SUMMARY OF THE INVENTION

The present invention provides a printer and a printer method for reducing a deviation between nozzles during printing.

According to an aspect of the present invention when a printhead including a first end and a second end sequentially prints a first area and a second area which are adjacent to each other, the printing method comprises the step of performing printing by relatively moving locations of the printhead and a print object in such a way that a surface printed by the second end in the first area and a surface printed by the second end in the second area face each other.

When the location of the printhead with respect to the print object switches from the first area to the second area, the printhead may rotate with respect to the print object.

The printhead may rotate around at least one point on the printhead constituting a rotation axis. The printhead may rotate around one end of the printhead constituting the rotation axis. The printhead may rotate around the center of the printhead constituting the rotation axis. The printhead may rotate around both ends of the printhead constituting the rotation axis.

A method of adjusting the locations of the printhead and the print object may comprise moving the print object with respect to the printhead.

A method of adjusting the locations of the printhead and the print object may comprise moving the printhead in parallel with the print object.

The printing method may be an inkjet printing method.

The printing method may be a nozzle printing method.

The printhead may spray a light emitting material so as to form a light emitting unit. The printhead may spray a pigment of a color filter layer so as to form a color filter layer. The printing method may be performed by using a plurality of the printheads, each spraying a pigment of a single color.

The printhead may be formed so as to tilt at a predetermined angle with respect to a moving direction of the print object on a print surface.

With respect to the print object, the printing method may further include: performing printing while moving the printhead in a first direction; moving the printhead in a second direction; rotating the printhead; performing printing while moving the printhead in a direction opposite to the first direction; moving the printhead in the second direction; and rotating the printhead.

The printing method may further include: performing printing while moving the print object in a direction opposite to a first direction with respect to the printhead; moving the print object in a direction opposite to a second direction; rotating the printhead; performing printing while moving the print object in the first direction with respect to the printhead; moving the print object in the direction opposite to the second direction; and rotating the printhead.

When the location of the printhead with respect to the print object switches from the first area to the second area, the printing method may further include controlling a location of the printhead so as to start printing in the second area, wherein the controlling of the location comprises: receiving the location of the printhead with respect to the print object, the location being received by a vision camera; and compensating the location of the printhead.

According to another aspect of the present invention, when a printhead including a first end and a second end sequentially prints a first area and a second area which are adjacent to each other, the printer performs printing by relatively moving locations of the printhead and a print object in such a way that a surface printed by the second end in the first area and a surface printed by the second end in the second area face each other.

When the location of the printhead with respect to the print object switches from the first area to the second area, the printhead may rotate with respect to the print object.

The printhead may rotate around at least one point on the printhead constituting a rotation axis. The printhead may rotate around one end of the printhead constituting the rotation axis. The printhead may rotate around the center of the printhead constituting the rotation axis. The printhead may rotate around both ends of the printhead constituting the rotation axis.

The printhead may include a plurality of nozzles.

The printer may perform printing using an inkjet printing method.

The printer may perform printing using a nozzle printing method.

When the location of the printhead with respect to the print object switches from the first area to the second area, the printer may further include a control system for controlling a location of the printhead to start printing in the second area, wherein the control system may include: a vision camera for receiving the location of the printhead with respect to the print object; and a compensator for compensating the location of the printhead.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Hereinafter, the present invention will be described more fully with reference to the accompanying drawings, in which exemplary embodiments of the invention are shown.

Figure 1:
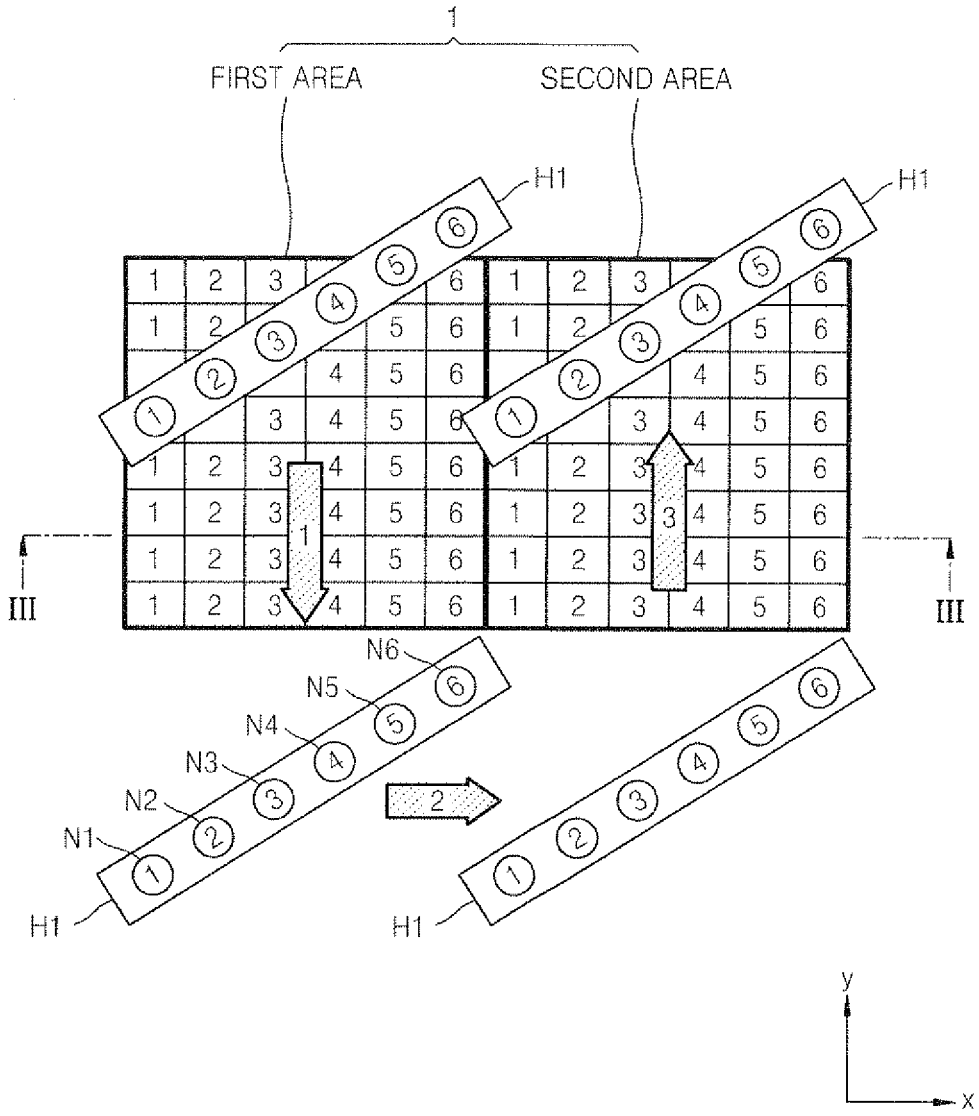
FIG. 1 is a conceptual schematic diagram illustrating movement of a printhead moving with respect to a print object according to a parallel movement when viewed from above according to an embodiment of the present invention.

FIG. 1 is a conceptual schematic diagram illustrating movement of a printhead moving with respect to a print object according to a parallel movement when viewed from above according to an embodiment of the present invention.

Referring to FIG. 1, the print object 1 includes a first area and a second area. The printhead H1 may print the first area while rectilinearly moving in a direction opposite to a Y-axis direction. After printing the first area, the printhead H1 moves below the print object 1 so as to move to the second area, and then moves to the second area in parallel with an X-axis. After moving to the second area in parallel with the X-axis, the printhead H1 prints the second area while rectilinearly moving in the Y-axis direction. Here, the printhead H1 may include a plurality of nozzles. For example, in FIG. 1, the printhead H1 includes a total of 6 nozzles, namely from a first nozzle N1 through a sixth nozzle N6.

The number and locations of the nozzles on the printhead H1 are not limited to the embodiment of FIG. 1, and may vary.

According to the current embodiment of the present invention, the first area is sequentially printed in the X-axis direction from the first nozzle N1 to the sixth nozzle N6, and the second area is also sequentially printed in the X-axis direction from the first nozzle N1 to the sixth nozzle N6. Accordingly, adjacent surfaces of the first and second areas are printed by using different nozzles.

In other words, referring to FIG. 1, the adjacent surfaces of the first and second areas are respectively printed by the sixth nozzle N6 and the first nozzle N1.

At this point, since the printhead H1 includes the plurality of nozzles N1 through N6, there may be a deviation between nozzles due to different discharge rates, or the like. Such a deviation may occur irregularly or regularly, and if the deviation occurs gradually, a difference between accumulated discharge rates of the first and sixth nozzle N1 and N6, respectively, may be higher than a difference between discharge rates of the adjacent first and second nozzles N1 and N2, respectively. Such a discharge rate deviation between the first and sixth nozzles N1 and N6, respectively, eventually generates a light emitting deviation which is easily perceived.

In order to decrease a deviation between nozzles, when a printhead H2 including a first end and a second end sequentially prints a first area and a second area, locations of the printhead H2 and the print object 1 may be adjusted in such a way that a surface printed by the second end in the first area and a surface printed by the second end by the second area face each other.

Figure 2:
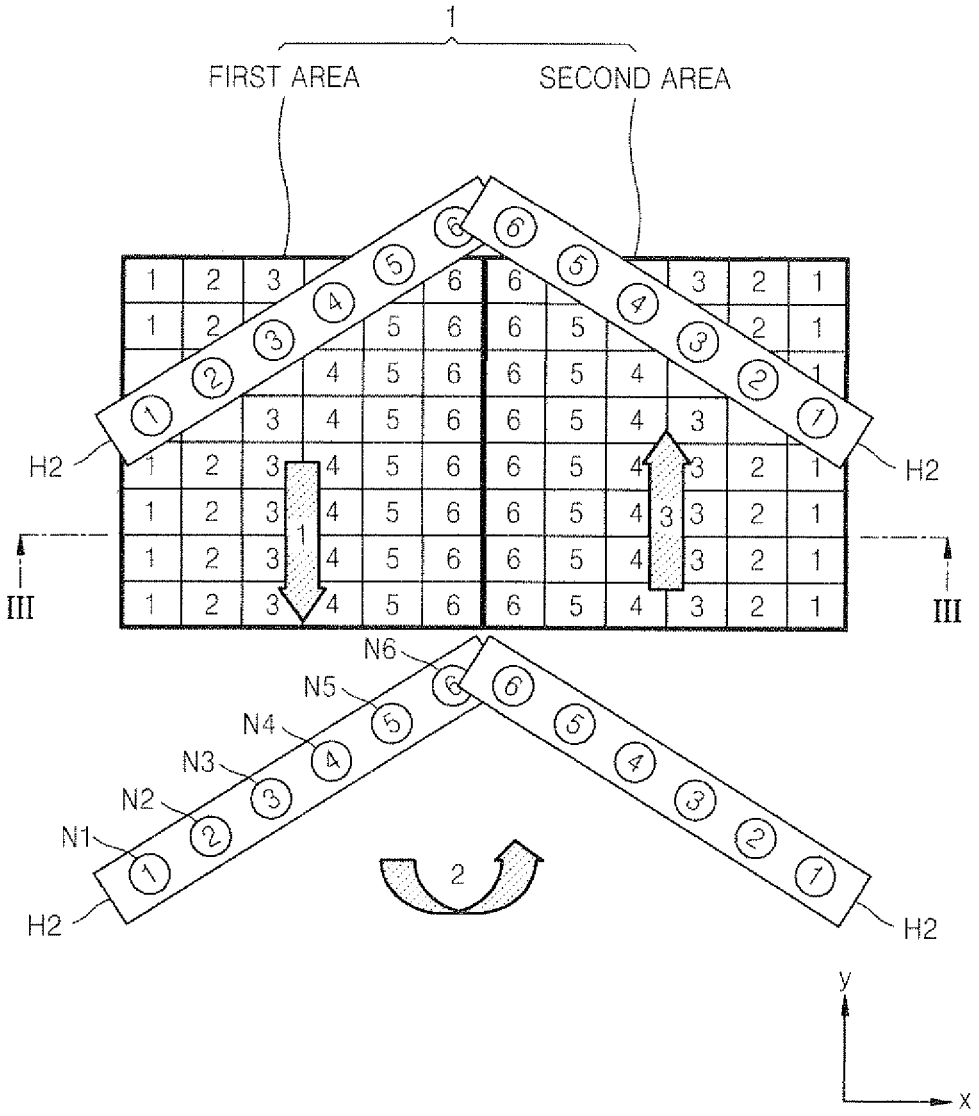
FIG. 2 is a conceptual schematic diagram illustrating a printhead switching from a first area to a second area according to a rectilinear movement and a rotary movement according to an embodiment of the present invention.

FIG. 2 is a conceptual schematic diagram illustrating the printhead switching from the first area to the second area according to a rectilinear movement and a rotary movement according to an embodiment of the present invention.

Referring to FIG. 2, the printhead H2 includes a first end where a first nozzle N1 is located and a second end where a sixth nozzle N6 is located. When the printhead H2 sequentially prints the first area and the second area, the printhead H2 may be rotated so that the surface printed by the second end, where the sixth nozzle N6 is located, in the first area and the surface printed by the second end, where the sixth nozzle N6 is located, in the second area face each other.

As shown in FIG. 2, the printhead H2 may be rotated based on a predetermined point so that adjacent surfaces of the first and second areas are printed by the same nozzle. Here, a surface printed by the second end denotes a surface on the first or second area which is printed by the second end. Similarly, a surface printed by the first end denotes a surface on the first or second area which is printed by the first end.

The effect of printing adjacent surfaces by using the same nozzle as shown in FIG. 2 will now be described with reference to FIG. 3.

Figure 3:
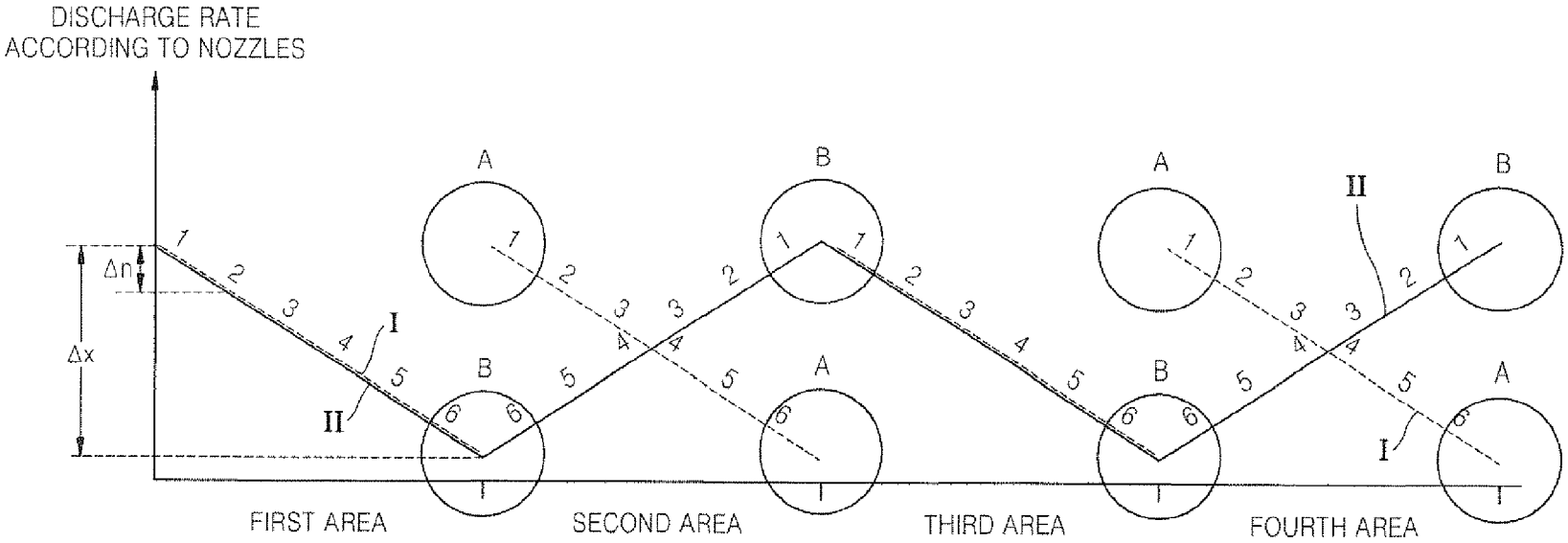
FIG. 3 is a diagram comparing discharge rates in a cross-section taken along a line III-III of FIG. 1 and a cross-section taken along a line III-III of FIG. 2.

FIG. 3 is a diagram comparing discharge rates in a cross-section taken along a line III-III of FIG. 1 and a cross-section taken along a line III-III of FIG. 2.

FIG. 3 illustrates a first straight line I showing discharge rates of the nozzles N1 thru N6 of FIG. 1 and a second straight line II showing discharge rates of the nozzles N1 thru N6 of FIG. 2. Here, it is assumed that the discharge rates of the first and sixth nozzles N1 and N6, respectively, of the printhead H1 or H2 are different from each other by $\Delta x$. In addition, looking at the first straight line I, the difference between the discharge rates is Δx at each adjacent point A.

On the other hand, looking at the second straight line II, there is no difference between the discharge rates at each adjacent point B, and only a deviation Δn between adjacent nozzles gradually occurs. Accordingly, a printing method or a printer may use the printhead H2 having the deviation Δn to reduce a deviation between nozzles on adjacent surfaces by printing the adjacent surfaces by using the same nozzle.

When a printhead including a first end and a second end sequentially prints a first area and a second area, a printing method according to an embodiment of the invention includes performing printing by adjusting locations of the printhead and a print object in such a way that a surface printed by the second end in the first area and a surface printed by the second end in the second area face each other, and this method will now be described with reference to FIGS. 4 thru 6.

Figure 4:
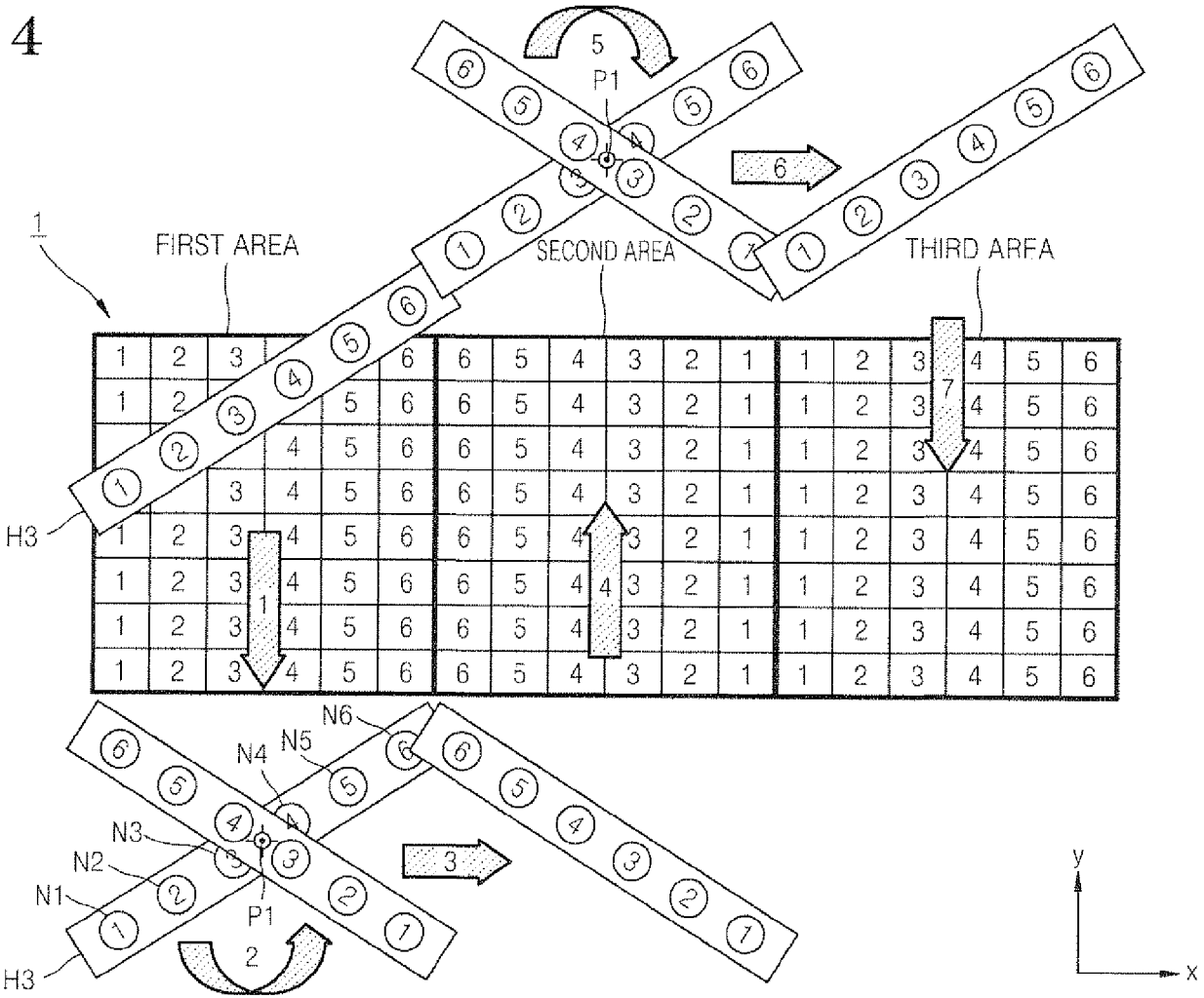
FIG. 4 is a conceptual schematic diagram illustrating movement of a printhead on a print object when viewed from above according to a modified example of the embodiment of FIG. 2.
Figure 5:
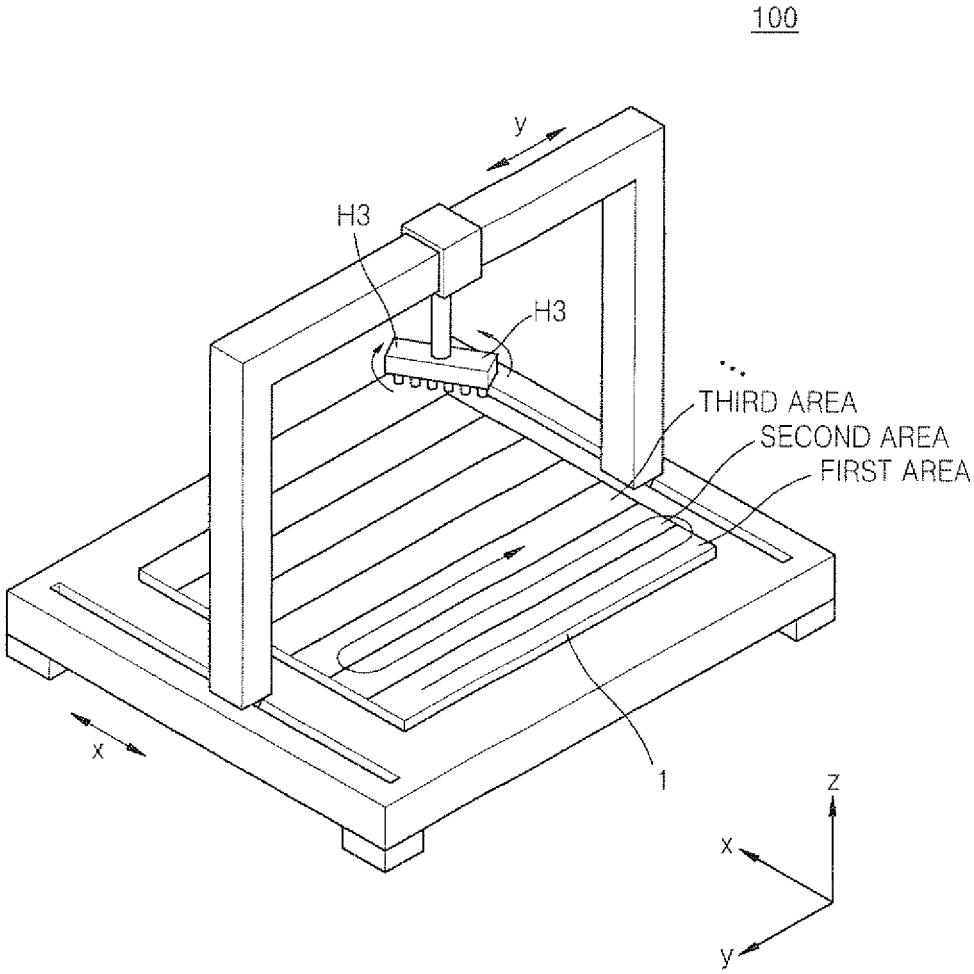
FIG. 5 is a schematic perspective view illustrating a printer having a printhead moving with respect to a print object.
Figure 6:
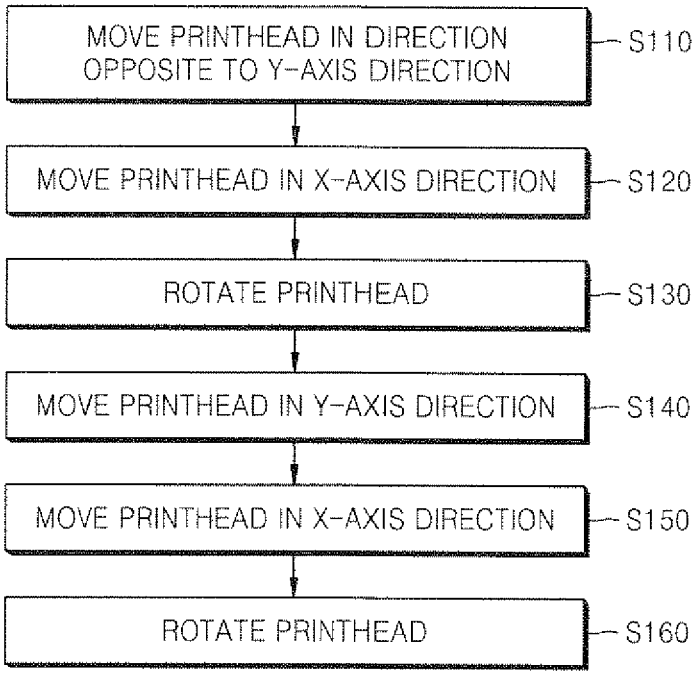
FIG. 6 is a flowchart of movement of the printhead of FIG. 5.

FIG. 4 is a conceptual schematic diagram illustrating movement of a printhead on a print object when viewed from above according to a modified example of the embodiment of FIG. 2, FIG. 5 is a schematic perspective view illustrating a printer having the printhead moving with respect to the print object, and FIG. 6 is a flowchart of movement of the printhead of FIG. 5.

Referring to FIG. 4, the printhead H3 may sequentially include first thru sixth nozzles N1 thru N6, respectively, arranged in a direction from a first end to a second end. Here, in operation S110 of FIG. 6, the printhead H3 may move in a direction opposite to a Y-axis direction while printing the first area. Then, the printhead H3 may move along an X-axis direction in operation S120. Next, the printhead H3 may rotate based on one point on the printhead H3 as a central axis P1 in operation S130. For example, the central axis P1 may be the center of the printhead H3, as shown in FIG. 4. The printhead H3, which is rotated based on the central axis P1, may print the second area while moving in the Y-axis direction in operation S140. When the second area is printed as such, a deviation between the adjacent surfaces of the first and second areas due to different discharge rates is reduced since the adjacent surfaces are printed by the sixth nozzle N6. When the printhead H3 passes through the print object 1 in the Y-axis direction after printing the second area, the printhead H3 may move in the X-axis direction in operation S150. The printhead H3 may then rotate based on the central axis in operation S160.

Next, operations S110 thru S160 of FIG. 6 may be repeated so as to print the print object 1. In other words, the printhead H3 may print a third area while moving in the direction opposite to the Y-axis direction. Here, as shown in FIG. 4, adjacent surfaces of the second and third areas are printed by the first nozzle N1, and thus there is no deviation between nozzles in each area. Such a printing method may be performed by the printer 100 of FIG. 5, wherein the print object 1 is fixed, and the printhead H3 moves along the X-axis or the Y-axis with respect to the print object 1 or rotates based on the central axis P1. However, the device for performing the printing method of FIG. 4 is not limited to the printer 100.

A modified example of the printer 100 will now be described with reference to FIGS. 7 and 8.

Figure 7:
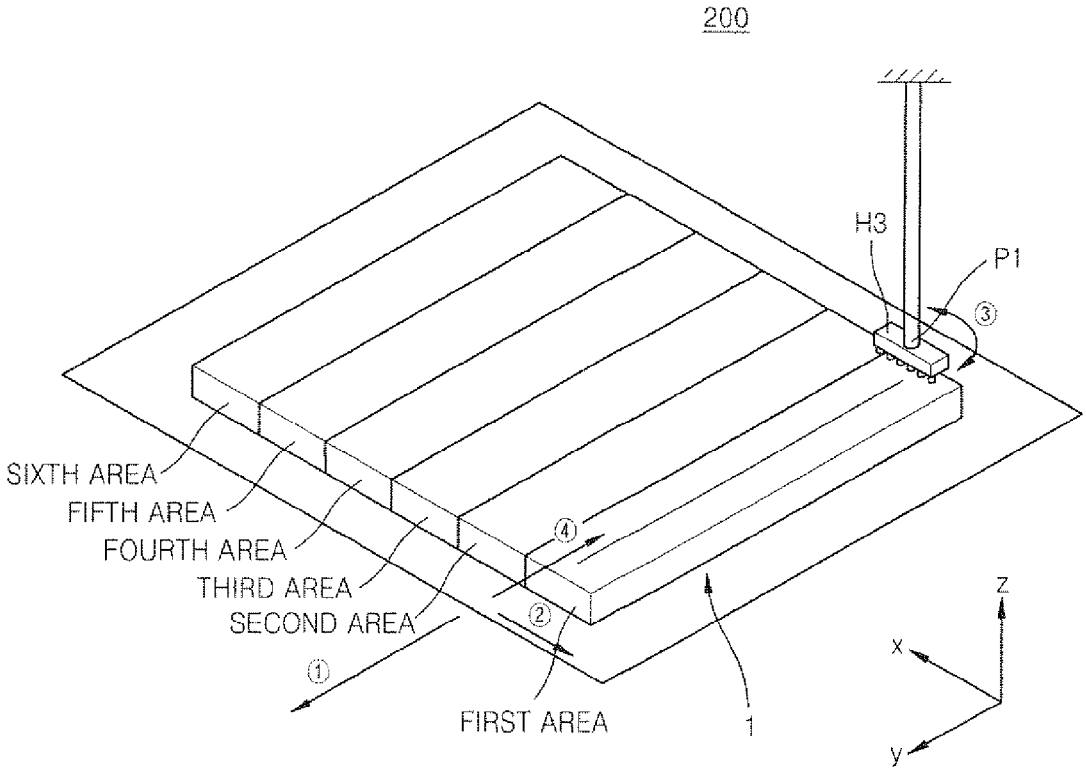
FIG. 7 is a schematic perspective view illustrating a print object in a parallel movement and a printer including a printhead in a rotary movement.
Figure 8:
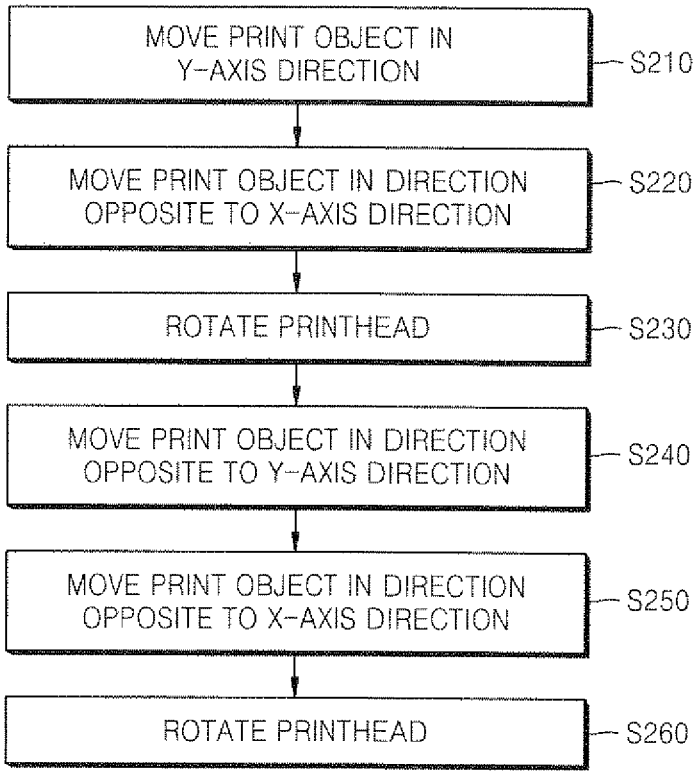
FIG. 8 is a flowchart of movements of the print object and the printhead of FIG. 7.

FIG. 7 is a schematic perspective view illustrating a printer which moves a print object in a straight line or rotates a printhead based on a central axis, and FIG. 8 is a flowchart of movements of the print object and the printhead of FIG. 7.

The printer 200 of FIG. 7 is configured to move the print object 1 in a straight line and rotate the printhead H3 based on the central axis P1. In order to print a first area of the print object 1, the print object 1 may move in a Y-axis direction in operation S210. Then, the print object 1 may move in a direction opposite to an X-axis direction in operation S220. Next, the printhead H3 may rotate based on the central axis P1 in operation S230. Then, the print object 1 may move in a direction opposite to the Y-axis direction while the printhead H3 prints a second area in operation S240. Next, the print object 1 may move in a direction opposite to the X-axis direction so as to print a third area in operation S250. Then, the printhead H3 may be rotated in operation S260. Operations S210 thru S260 of FIG. 8 may be repeated to print the print object 1. In other words, the printhead H3 may print the third area while moving the print object 1 in the Y-axis direction.

The structure of the printer 100 or 200 and the printing method are not limited thereto. For example, the printer 100 may adjust a relative distance between the printhead H3 and the print object 1 by fixing the printhead H3 and moving the print object 1 in a straight line and rotating the print object 1 based on the central axis P1. Alternatively, the relative distance between the printhead H3 and the print object 1 may be adjusted by moving the printhead H3 and the print object 1 in a straight line and rotating the printhead H3 and the print object 1 based on the central axis P1. Alternatively, the printer 100 may adjust a relative distance between the printhead H3 and the print object 1 by fixing the printhead H3 and moving the print object 1 along a direction perpendicular to printhead.

A control system for compensating for the location of the printhead H3 by compensating a rotation angle θ of the printhead H3 may be used to precisely adjust a relative distance between the printhead H3 and the print object 1 while changing locations of the nozzles N1 thru N6 by rotating the printhead H3. Location compensation of the printhead H3 will now be described with reference to FIGS. 9 and 10.

Figure 9:
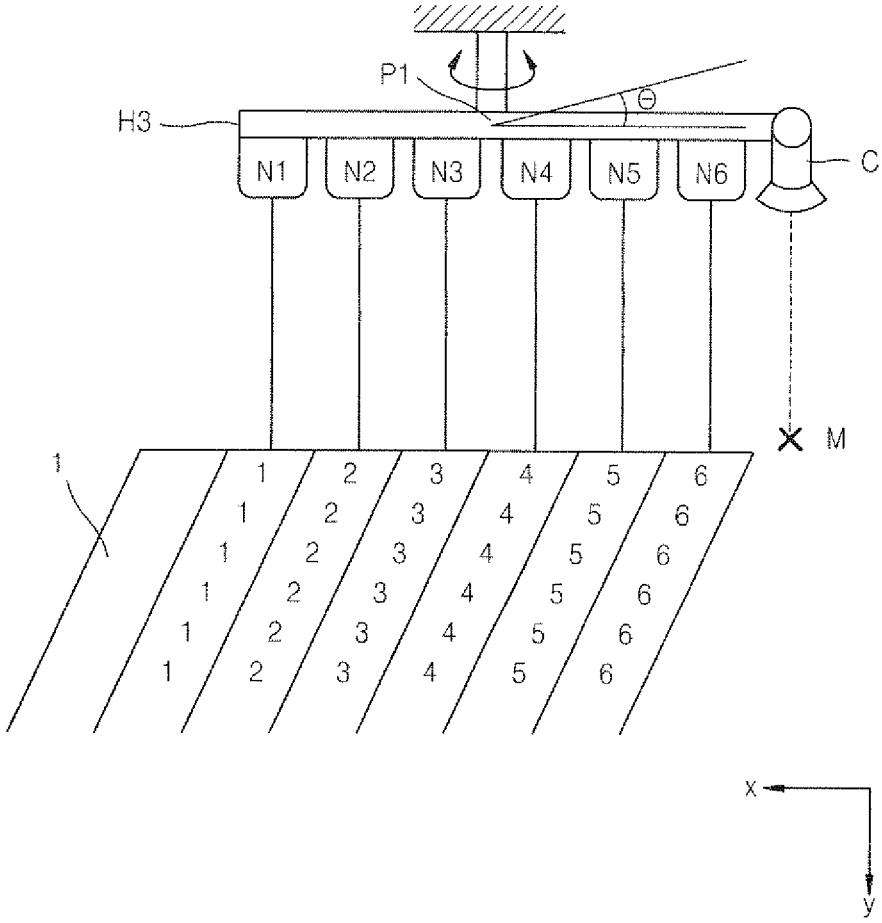
FIG. 9 is a schematic perspective view illustrating the printhead of FIG. 5 for describing location compensation of the printhead.
Figure 10:
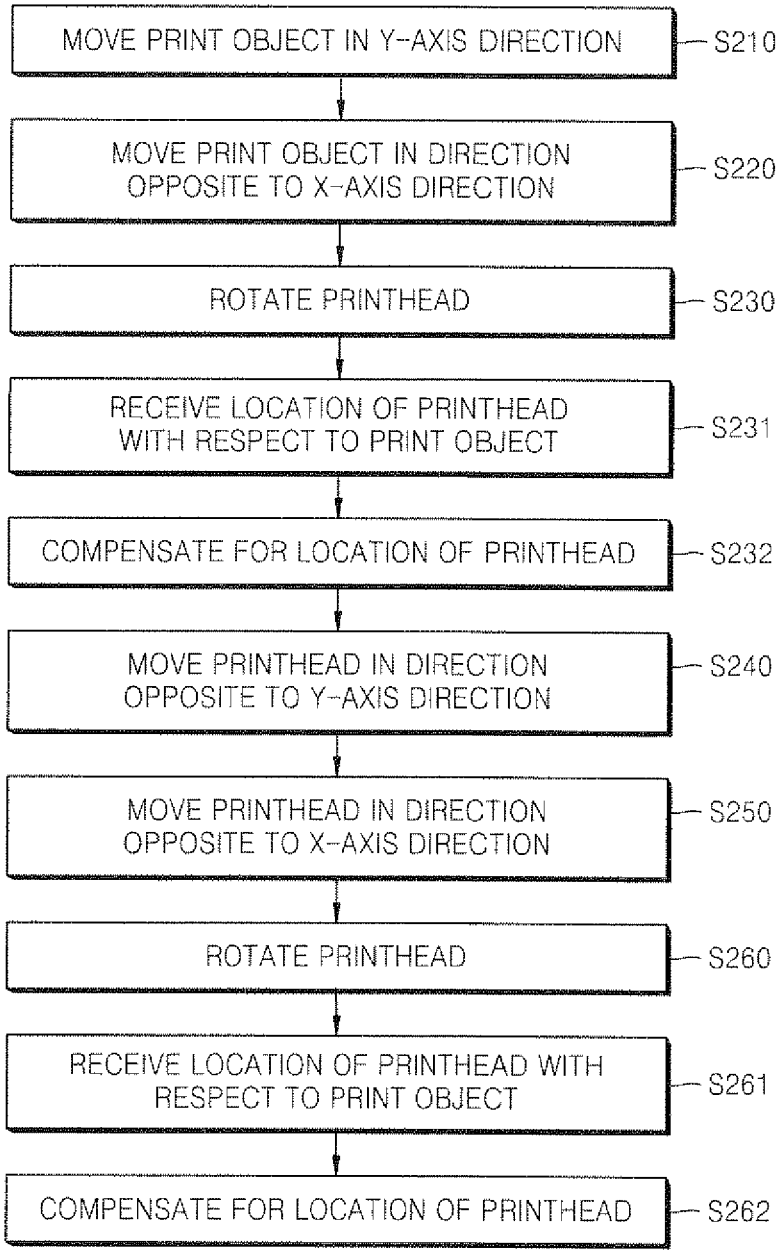
FIG. 10 is a flowchart of movement and location compensation of the printhead of FIG. 9.

FIG. 9 is a schematic perspective view illustrating the printhead of FIG. 5 for describing location compensation of the printhead, and FIG. 10 is a flowchart of movement and location compensation of the printhead of FIG. 9.

When the location of the printhead H3 switches from a first area to a second area with respect to the print object 1, the control system controls a location of the printhead H3 so as to start printing on the second area. Here, the current embodiment of the present invention is described in the situation where the printhead H3 switches from the first area to the second area, but the invention is not limited thereto, and the printhead H3 may switch to any adjacent area. Referring to FIG. 9, the printhead H3 includes a vision camera C. Also, since an align mark M is marked on the print object 1 or a surrounding stage, the vision camera C may read the align mark M and adjust the rotation angle θ of the printhead H3 so as to compensate for the location of the printhead H3. Accordingly, the control system may receive the location of the printhead H3 with respect to the print object 1 (operations S231 and S261 of FIG. 10), and compensate for the location of the printhead H3 (operations S232 and S262). Since operations S231 and S232, and operations S261 and S262, are performed before moving the printhead H3 along a Y-axis direction after rotating the printhead H3, operations S231 and S232, and operations S261 and S262, may be performed between rotation of the printhead H3 and movement of the print object in the Y-axis direction, as illustrated in the flowchart of FIG. 8. In other words, referring to FIG. 10, in order to print the first area of the print object 1, the print object 1 may move in a Y-axis direction in operation S210. Then, the print object 1 may move along a direction opposite to an X-axis direction in operation S220. Next, the printhead H3 may be rotated based on a central axis P1 in operation S230. Then, the location of the printhead H3 with respect to the print object 1 may be received in operation S231. Next, the location of the printhead H3 may be compensated for in operation S232. Then, the second area may be printed while moving the print object 1 in a direction opposite to the Y-axis direction in operation S240. Next, in order to print a third area, the print object 1 may be moved in the direction opposite to the X-axis direction in operation S250. Then, the printhead H3 may be rotated in operation S260. Next, the location of the printhead H3 with respect to the print object 1 may be received in operation S261. Then, the location of the printhead H3 may be compensated for in operation S262. Next, operations S210 thru S262 of FIG. 10 may be repeated so as to print the print object 1. In other words, the third area may be printed while moving the print object 1 in the Y-axis direction.

FIGS. 11 thru 14 are various modified examples of FIG. 2.

In FIGS. 11 thru 14, a print object 1 is fixed and a print head H4, H5, H6, or H7 is moved, but an embodiment of the present invention is not limited thereto, and at least one of the print object 1 and the print head H4, H5, H6, or H7 may be moved. In other words, the print object 1 may move in a straight line and the print head H4, H5, H6, or H7 may rotate based on the central axis P1, or both the print object 1 and the print head H4, H5, H6, or H7 may move in a straight line and rotate based on the central axis P1. Also, when the print head H4, H5, H6, or H7 or the print object 1 rotates, a location of the print head H4, H5, H6, or H7 may be additionally compensated as described with reference to FIGS. 9 and 10.

Figure 11:
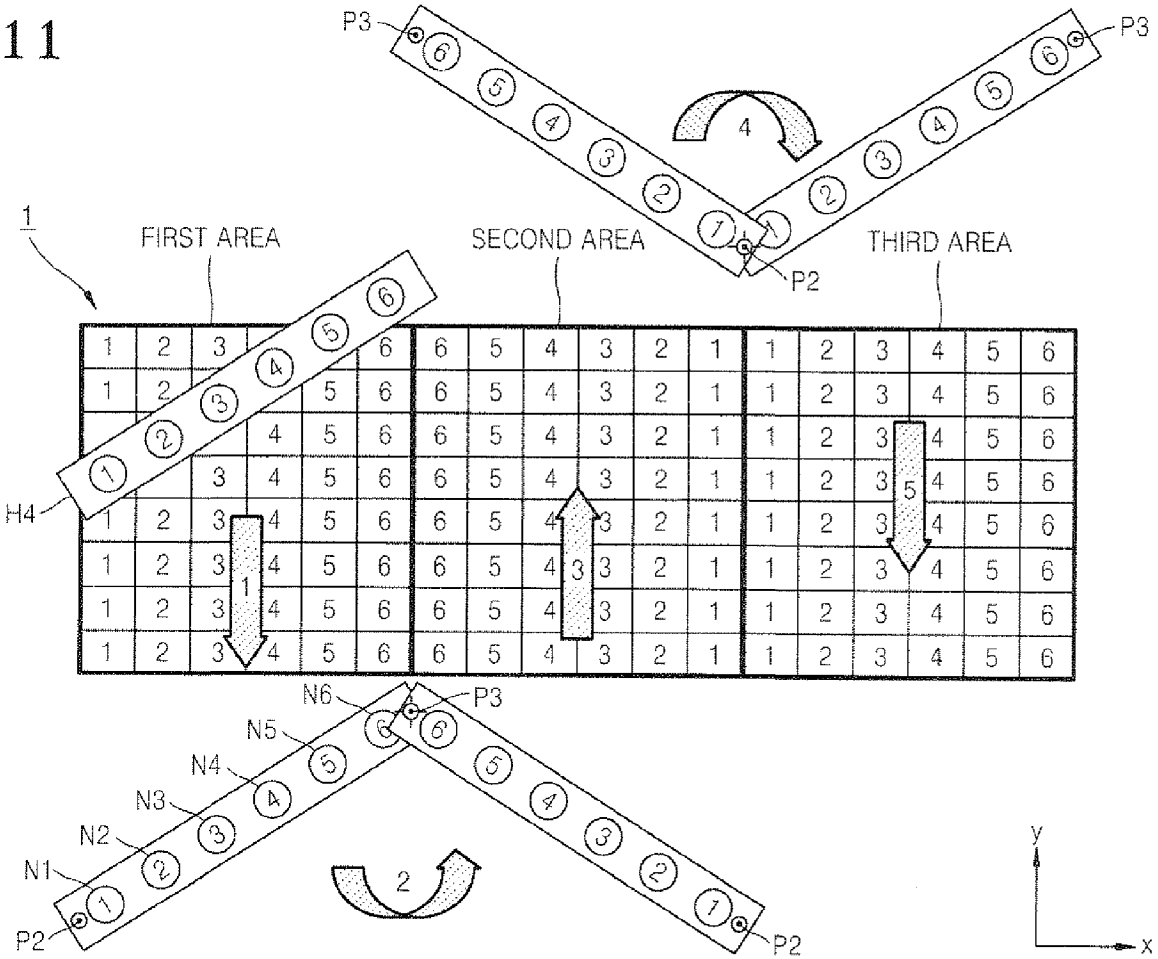
FIG. 11 is a conceptual schematic diagram illustrating movement of a printhead on a print object when viewed from above according to another modified example of the embodiment of FIG. 2.

FIG. 11 is a conceptual schematic diagram illustrating movement of the printhead on the print object when viewed from above according to another modified example of the embodiment of FIG. 2.

Referring to FIG. 11, the printhead H4 includes first thru sixth nozzles N1 thru N6, respectively, a first rotation axis P2 on a first end of the printhead H4 where the first nozzle N1 is located, and a second rotation axis P3 on a second end where the sixth nozzle N6 is located. A first area may be printed while moving the printhead H4 in a direction opposite to a Y-axis direction. Then, the printhead H4 may be rotated based on the second rotation axis P3. Next, a second area may be printed while moving the printhead in the Y-axis direction. Then, the printhead H4 may be rotated based on the first rotation axis P2. Next, a third area may be printed while moving the printhead H4 in the direction opposite to the Y-axis. Such processes may be repeated so as to print the print object 1.

Figure 12:
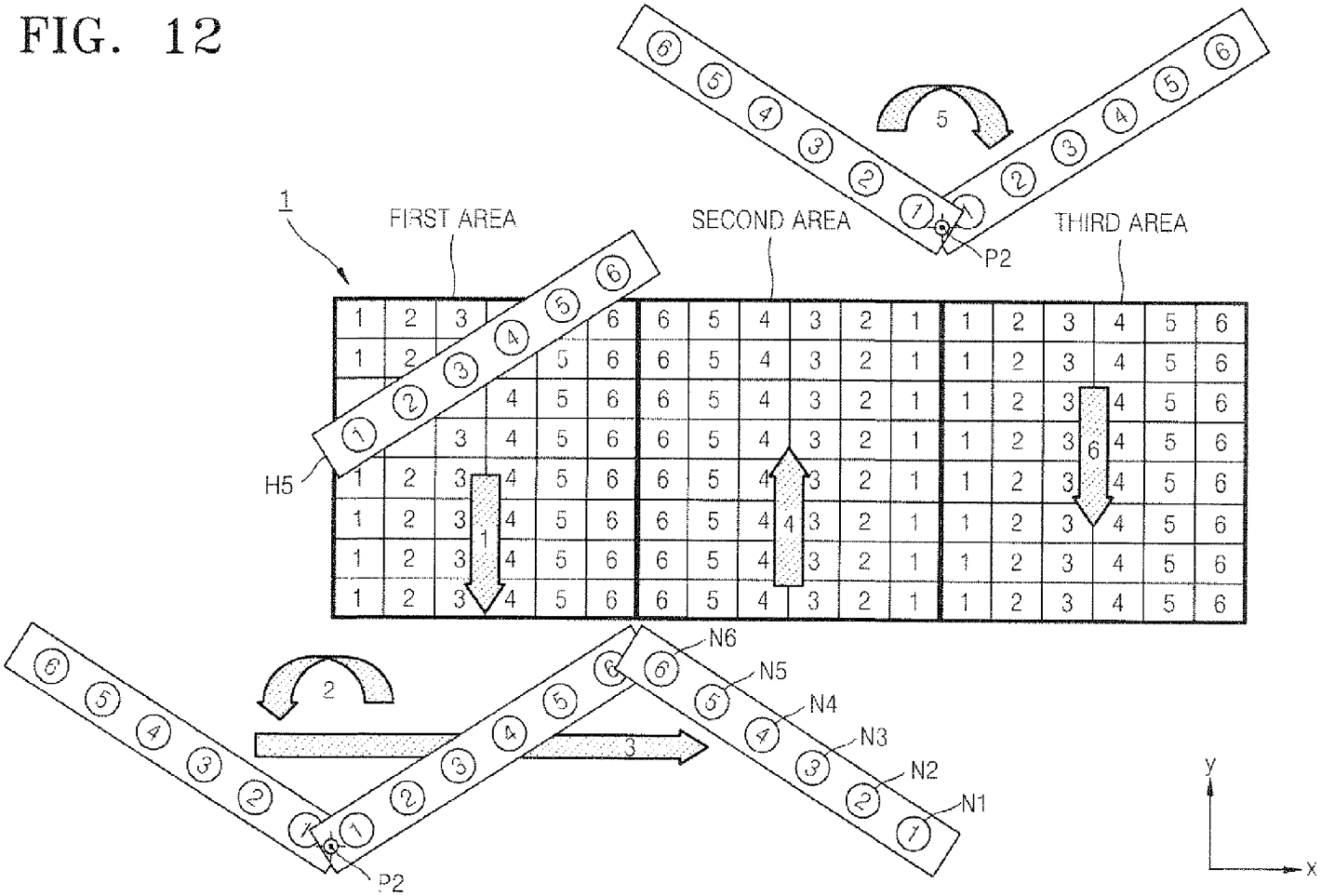
FIG. 12 is a conceptual schematic diagram illustrating movement of a printhead on a print object when viewed from above according to another modified example of the embodiment of FIG. 2.

FIG. 12 is a conceptual schematic diagram illustrating movement of the printhead on a print object when viewed from above according to another modified example of the embodiment of FIG. 2.

Referring to FIG. 12, the printhead H5 includes first thru sixth nozzles N1 through N6, respectively, and a first rotation axis P2 on a first end of the printhead H5 where the first nozzle N1 is located. A first area may be printed while moving the printhead H5 in a direction opposite to a Y-axis direction. Then, the printhead H5 may be rotated based on the first rotation axis P2. Here, the printhead H5 may rotate clockwise or counterclockwise. Next, the printhead H5 may move in an X-axis direction. Then, a second area may be printed while moving the printhead H5 in the Y-axis direction. Next, the printhead H5 may again be rotated based on the first rotation axis P2. Here, the printhead H5 may not move in the X-axis direction, and a third area may be printed while again moving the printhead H5 in the direction opposite to the Y-axis direction. The print object 1 may be printed by repeating the above processes. The printhead H4 of FIG. 11 includes two rotation axes P2 and P3, whereas the printhead H5 of FIG. 12 includes one rotation axis P2 to change directions.

Figure 13:
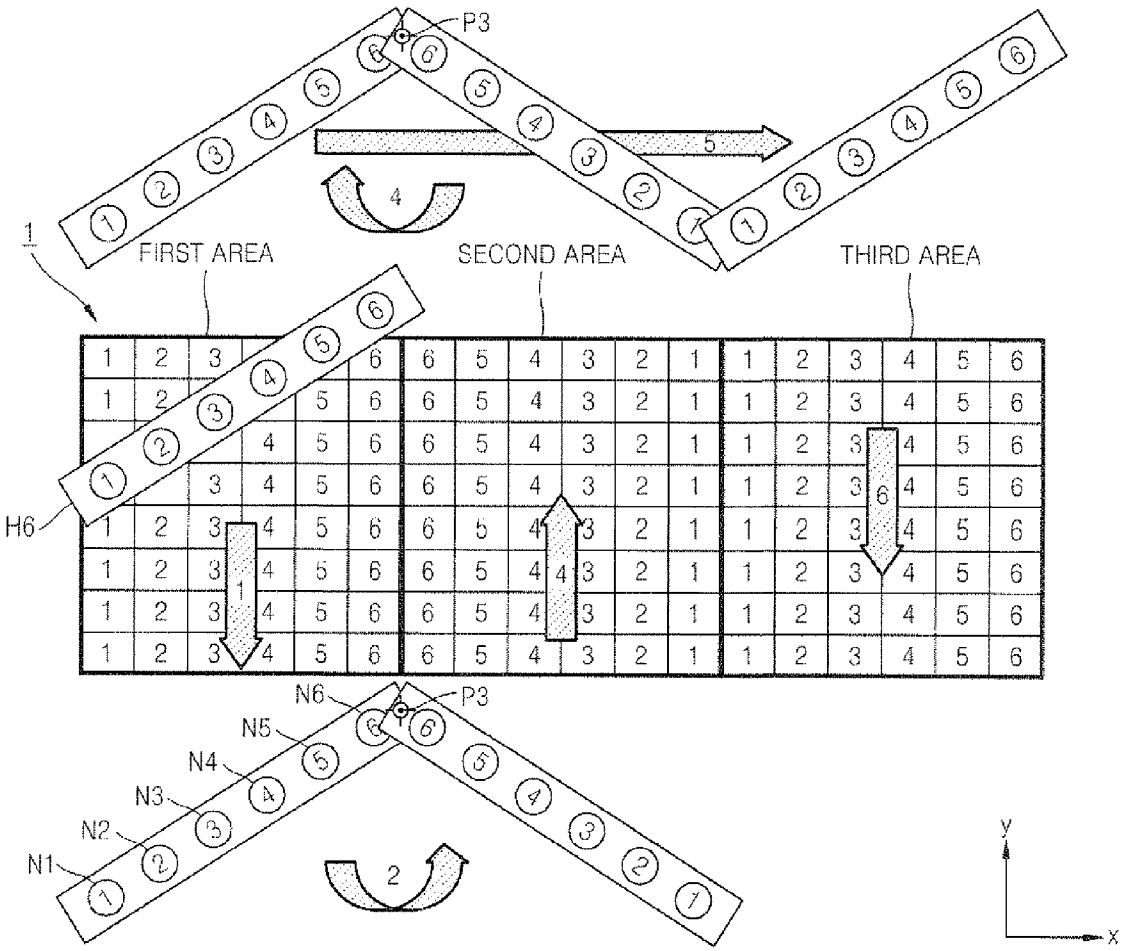
FIG. 13 is a conceptual schematic diagram illustrating movement of a printhead on the print object when viewed from above according to another example of the embodiment of FIG. 2.

FIG. 13 is a conceptual schematic diagram illustrating movement of the printhead on the print object when viewed from above according to another example of the embodiment of FIG. 2.

Referring to FIG. 13, the printhead H6 includes first thru sixth nozzles N1 through N6, respectively, and a second rotation axis P3 on a second end of the printhead H6 where the sixth nozzle N6 is located. A first area may be printed while moving the printhead H6 in a direction opposite to a Y-axis direction. Then, the printhead H6 may be rotated based on the second rotation axis P3. Next, a second area may be printed while moving the printhead H6 in the Y-axis direction. Then, the printhead H6 may be rotated again based on the second rotation axis P3. Next, the printhead H6 may be moved in the X-axis direction so as to adjust alignment of the printhead H6 and the print object 1. Then, a third area may be printed while moving the printhead H6 in the direction opposite to the Y-axis direction. The print object 1 may be printed by repeating the above processes.

Figure 14:
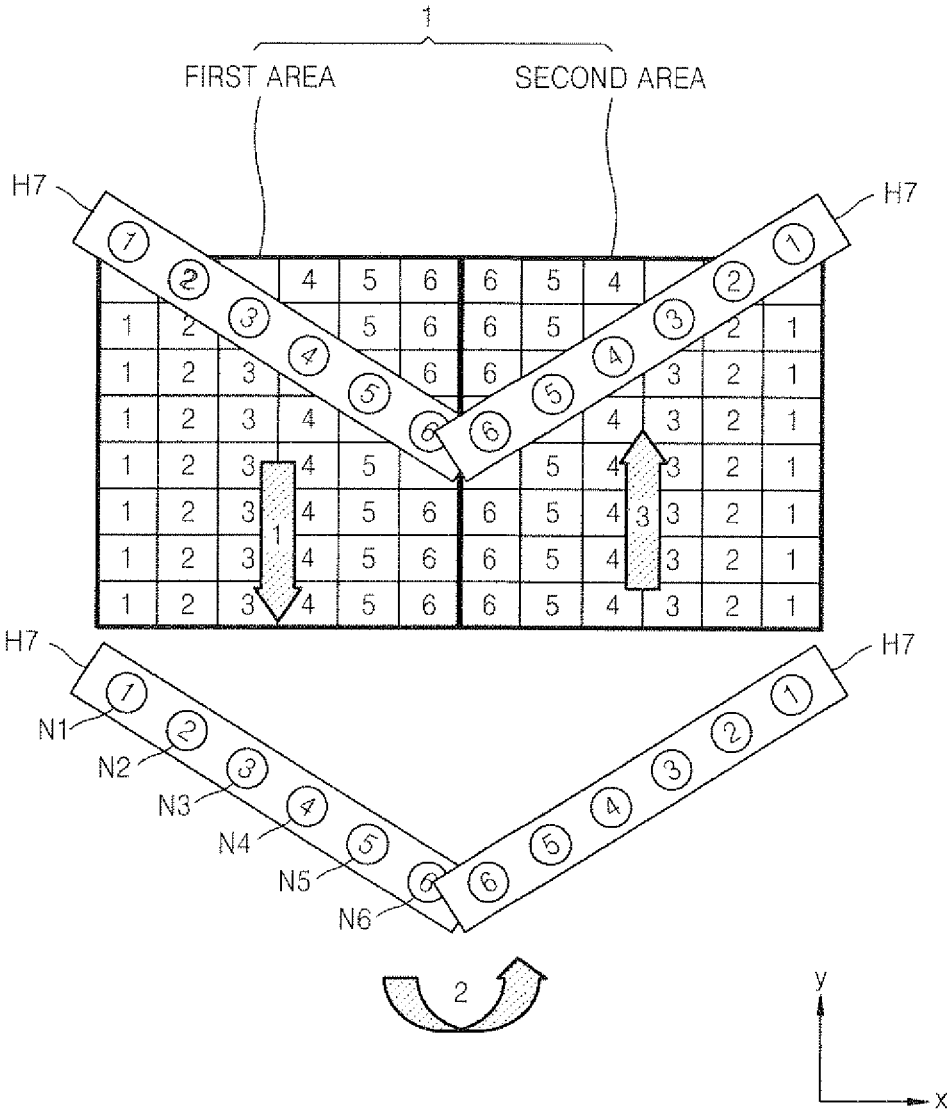
FIG. 14 is a conceptual schematic diagram illustrating movement of a printhead on a print object when viewed from above according to another example of the embodiment of FIG. 2.

FIG. 14 is a conceptual schematic diagram illustrating movement of the printhead on the print object when viewed from above according to another example of the embodiment of FIG. 2.

FIG. 14 shows that the printhead H7 may tilt in any direction. For example, the printhead H2 of FIG. 2 may have a high right and a low left with respect to a moving direction, and the printhead H7 of FIG. 14 may have a low right and a high left with respect to a moving direction.

The print object 1 to be printed according to the printing methods and the printers 100 and 200 of FIGS. 2 thru 14 is not limited, and any printable object may be used. For example, the print object 1 may be a substrate 10, including a plurality of pixel regions PR.

A method of printing the substrate 10 will now be described with reference to FIG. 15.

Figure 15:
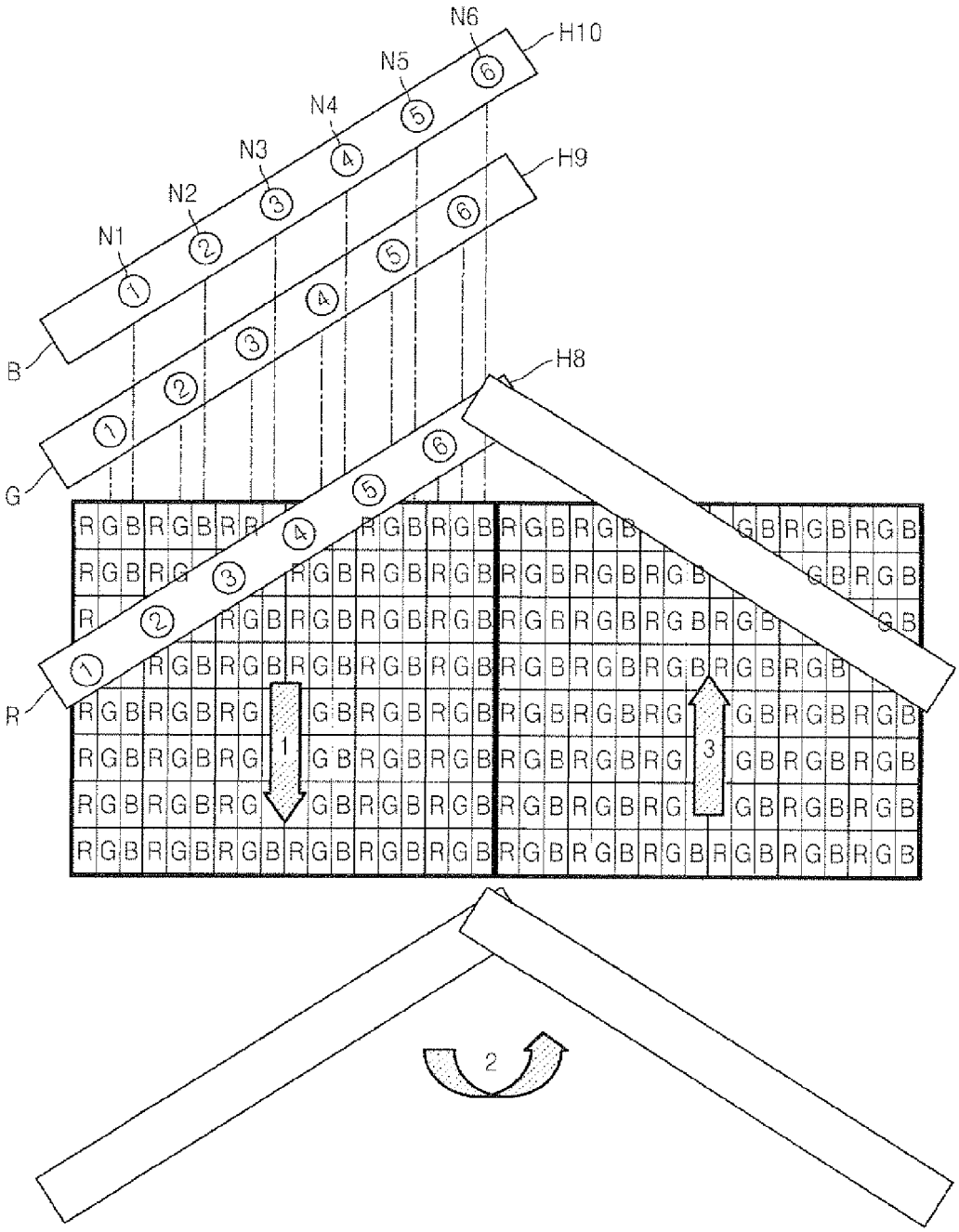
FIG. 15 is a conceptual schematic diagram illustrating a plurality of printheads used to print red, green, and blue, respectively, on a print object when viewed from above according to the embodiment of FIG. 2.

FIG. 15 is a conceptual schematic diagram illustrating a plurality of printheads used to print red (R), green (G), and blue (B), respectively, on a print object when viewed from above according to the embodiment of FIG. 2.

The plurality of pixel regions PR may be formed in a matrix on the substrate 10. A pixel pattern may be formed in the pixel region PR so as to display an image. For example, when the resolution of the substrate 10 is 1024×768, about 1024×768×3 pixel regions PR may be formed on the substrate 10. Here, each pixel region PR may be filled with a light emitting material of R, G, or B. In addition, the printhead H8 may spray the light emitting material of R. Also, the printhead H9 may spray the light emitting material of G, and the printhead H10 may spray the light emitting material of B. Here, the printheads H8, H9, and H10 may form a color filter by respectively spraying an R color filter material, a G color filter material, and a B color filter material, wherein the R, G, and B color filter materials each emit a single color light by filtering a white light.

The printing method may be an inkjet printing method or a nozzle printing method.

According to the embodiments of the present invention, a light emitting deviation is reduced by reducing a deviation between nozzles during printing.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A printing method, comprising:

providing a printhead comprising a first end and a second end disposable to sequentially print on a print object including a first area that includes a first edge and a second edge and a second area that includes a third edge and a fourth edge, the second edge of the first area and the third edge of the second area adjacent to each other;

performing printing in the first area by moving relative positions of the printhead and the print object, the first edge and the second edge of the first area printed by the first end and the second end, respectively; and performing printing in the second area by moving the relative positions of the printhead and the print object, the third edge and the fourth edge of the second area printed by the second end and the first end, respectively.

2. The printing method of claim 1, wherein, when the position of the printhead with respect to the print object switches from the first area to the second area, the printhead rotates with respect to the print object.

3. The printing method of claim 2, wherein the printhead rotates around at least one point on the printhead constituting a rotation axis.

4. The printing method of claim 3, wherein movement of the printhead comprises one of rotation around one end of the printhead, rotation about a center of the printhead and rotation about both ends of the printhead, constituting the rotation axis.

5. The printing method of claim 1, further comprising adjusting the positions of the printhead and the print object by moving them relative to each other.

6. The printing method of claim 5, further comprising adjusting the positions of the printhead and the print object by moving the print object with respect to the printhead.

7. The printing method of claim 6, wherein movement of the print object comprises one of movement in parallel with the printhead, movement along a direction perpendicular to the printhead, and rotation around the rotation axis.

8. The printing method of claim 5, further comprising adjusting the positions of the printhead and the print object by moving the printhead with respect to the print object.

9. The printing method of claim 8, wherein movement of the printhead comprises one of movement in parallel with the print object and rotation around a rotation axis.

10. The printing method of claim 1, wherein the method comprises one of an inkjet printing method and a nozzle printing method.

11. The printing method of claim 1, wherein the printhead sprays a light emitting material to form a light emitting unit.

12. The printing method of claim 1, wherein the printhead sprays a pigment of a color filter layer to form a color filter layer.

13. The printing method of claim 1, wherein a plurality of the printheads are used to spray a pigment of a single color.

14. The printing method of claim 1, wherein the printhead is formed so as to tilt at a predetermined angle with respect to a moving direction of the print object on a print surface.

15. The printing method of claim 1, further comprising the steps, with respect to the print object, of:

performing printing while moving the printhead in a first direction;

moving the printhead in a second direction;

rotating the printhead;

performing printing while moving the printhead in a direction opposite to the first direction;

moving the printhead in the second direction; and rotating the printhead.

16. The printing method of claim 1, further comprising the steps of:

performing printing while moving the print object in a direction opposite to a first direction with respect to the printhead;

moving the print object in a direction opposite to a second direction;

rotating the printhead;

performing printing while moving the print object in the first direction with respect to the printhead;

moving the print object in the direction opposite to the second direction; and rotating the printhead.

17. The printing method of claim 1, further comprising the steps, when the position of the printhead with respect to the print object switches from the first area to the second area, of controlling a position of the printhead to start printing in the second area, wherein the step of controlling the position of the printhead comprises:

receiving the position of the printhead with respect to the print object from a vision camera; and compensating the position of the printhead.

18. A printer, comprising:

a printhead relatively movable back and forth with respect to a print object including a first area and a second area to be sequentially printed by the printer; along a first direction and a second direction crossing the first direction, the printhead including a first end and a second end; and a control system controlling an angle formed between a direction from the first end to the second end and the second direction by rotating the printhead, the angle being an acute angle when the printhead prints the first area, and the angle being an obtuse angle when the printer prints the second area.

19. The printer of claim 18, wherein, when the position of the printhead with respect to the print object switches from the first area to the second area, the printhead rotates with respect to the print object.

20. The printer of claim 19, wherein the printhead rotates around at least one point on the printhead constituting a rotation axis.

21. The printer of claim 20, wherein the printhead rotates around one of one end of the printhead, a center of the printhead, and both ends of the printhead, constituting the rotation axis.

22. The printer of claim 18, wherein the printhead comprises a plurality of nozzles.

23. The printer of claim 18, wherein the printer performs printing using one of an inkjet printing method and a nozzle printing method.

24. The printer of claim 18, wherein the control system comprises:

a vision camera receiving the position of the printhead with respect to the print object; and a compensator compensating the position of the printhead.

* * * * *